United States Patent [19]

Terlecky et al.

[11] Patent Number: 4,905,608

[45] Date of Patent: Mar. 6, 1990

[54] RAILROAD WELL CAR

[75] Inventors: Boris S. Terlecky, Woodridge; Ronald P. Sellberg, Naperville; Frank F. Stec, Evergreen Park, all of Ill.

[73] Assignee: Trailer Train Company, Chicago, Ill.

[21] Appl. No.: 322,997

[22] Filed: Mar. 14, 1989

[51] Int. Cl.[4] ..... B61D 3/20; B61F 1/08

[52] U.S. Cl. ..... 105/355; 105/404; 105/422

[58] Field of Search ..... 105/355, 372, 404, 411, 105/418, 419, 422, 370; 410/54, 52, 68

[56] References Cited

U.S. PATENT DOCUMENTS

| | | | |
|---|---|---|---|
| 2,305,444 | 12/1942 | Pond | 414/788 |
| 3,319,583 | 5/1967 | Gutridge | 410/80 |
| 3,357,371 | 12/1967 | Gutridge | 410/54 |
| 3,389,663 | 6/1968 | Gutridge | 410/82 |
| 4,091,742 | 5/1978 | Cordani | 105/418 |
| 4,456,413 | 6/1984 | Pavlick | 410/56 |
| 4,599,949 | 7/1986 | Hill | 105/355 |
| 4,754,709 | 7/1988 | Gramse et al. | 105/355 |
| 4,805,539 | 2/1989 | Ferris et al. | 105/355 |

*Primary Examiner*—Andres Kashnikow
*Assistant Examiner*—Mark T. Le
*Attorney, Agent, or Firm*—Kinzer, Plyer, Dorn, McEachran & Jambor

[57] ABSTRACT

A railroad car for carrying containers has a car body mounted on trucks. The car body includes two side sills connected to two end frames. The side sills and end frames define an open well which is adapted for receiving a container. The floor of the well is defined by a container support frame assembly which is hung from the side sills by four hanger straps. The container support frame assembly includes two transverse support beams. The hanger straps are pivotally connected by transverse pins to the side sills and the transverse support beams such that the hanger straps are stressed primarily in tension only and they transfer tensile loads but not bending loads to the side sills.

44 Claims, 4 Drawing Sheets

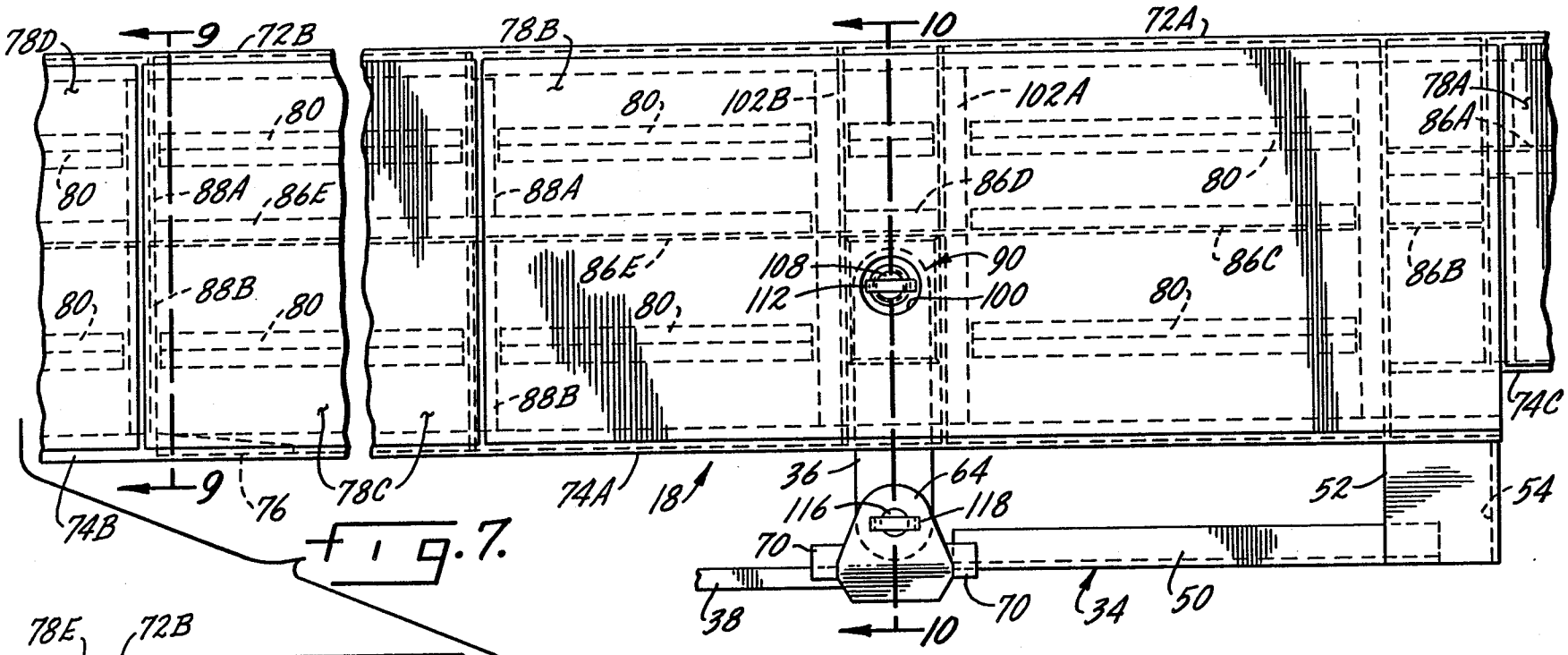
FIG. 7.
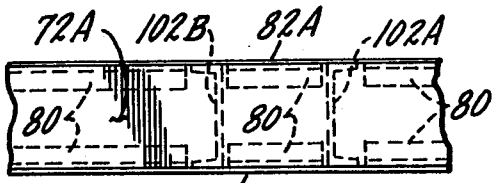
FIG. 8.
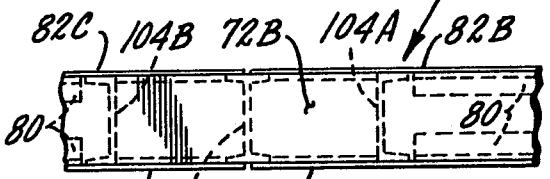
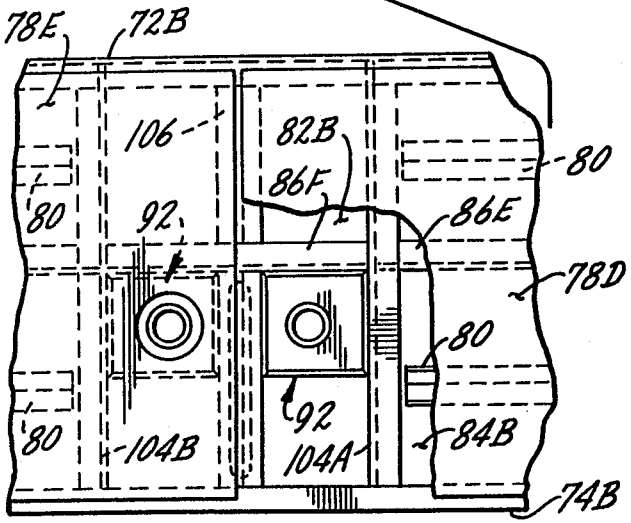

Fig. 9.
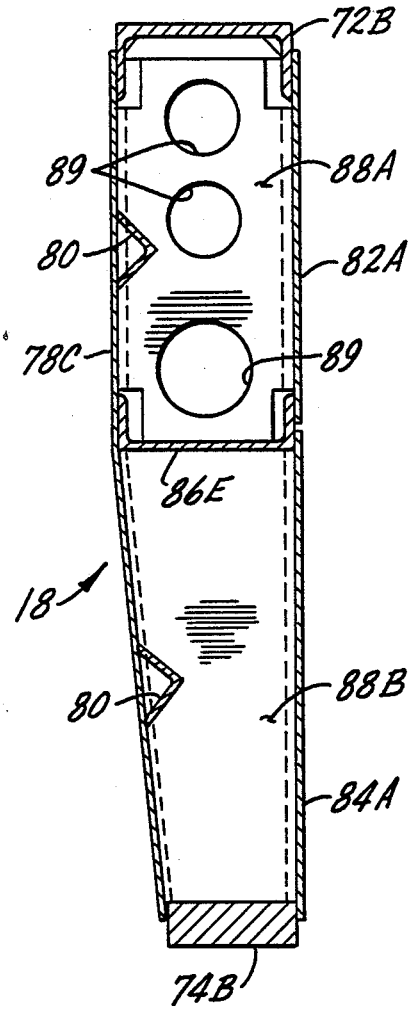
Fig. 10.
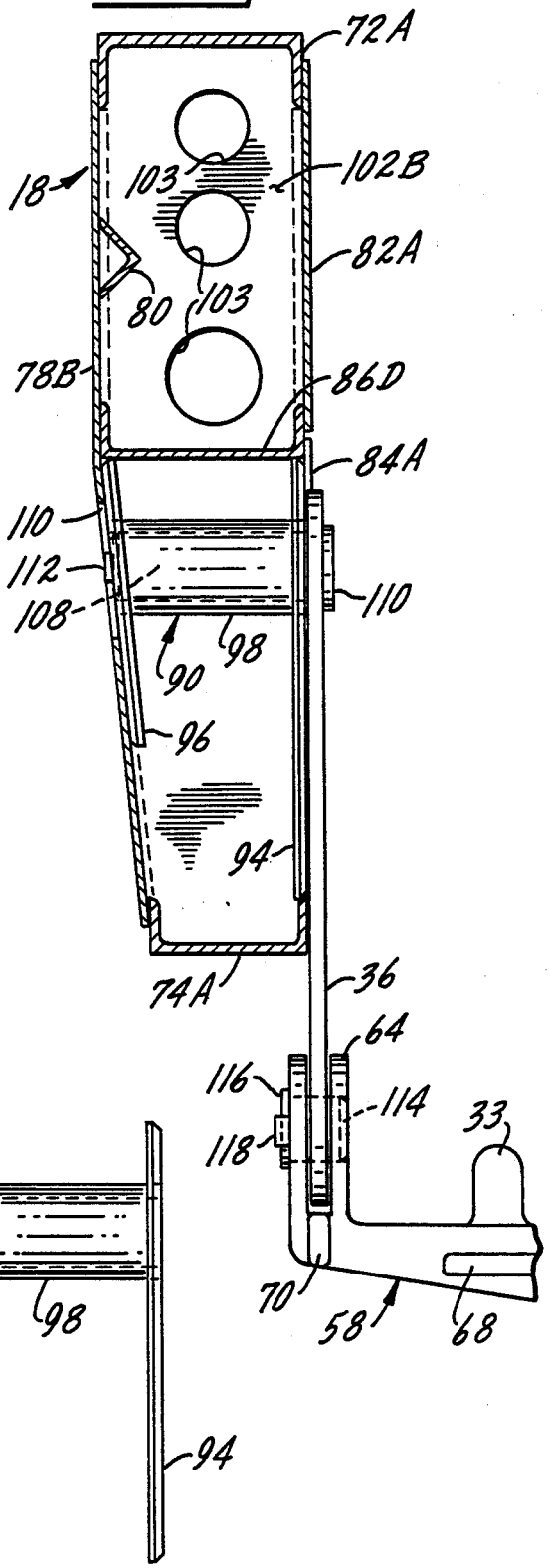
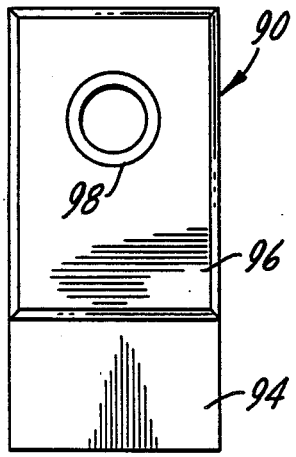
Fig. 11.
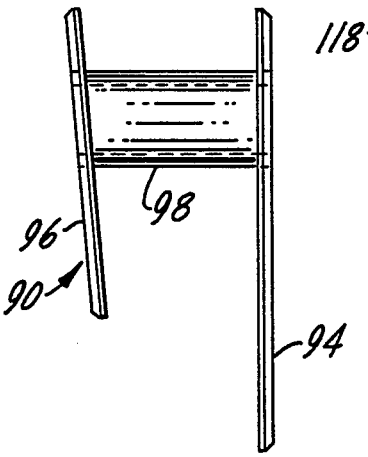
Fig. 12.

RAILROAD WELL CAR

BACKGROUND OF THE INVENTION

This invention relates to railroad cars of the type commonly referred to as well cars and used to transport cargo containers. Well cars have a car body mounted on suitable trucks. The car body typically includes two side sills connected to draft sill assemblies. The side and draft sills define a well between the trucks. Container supports are attached to the side sills for supporting a container in the well. The well receives the container at about the lowest possible elevation above the track. Consequently, a loaded well car has a lower center of gravity compared to a standard flat car and admits the possibility of stacking two containers in a car.

The container supports, of course, have to transfer the weight of the container to the side sills. Since the vertical load of the container is applied at points located laterally inwardly of the side sills, bending moments are applied to the container supports, which in turn transfer the moments to the side sills. The situation with regard to bending moments is complicated by the fact that different container widths are used so the moment arm will vary. Providing a container support structure capable of withstanding the applied loads has been a troublesome matter in well car design.

Welded structures which essentially provide a support ledge at the bottom of the side sills have proven to be susceptible to fatigue failure. Attempts to combat the problem by simply making bigger support structures are costly both in terms of economics and space considerations. Large, bulky container supports leave less room for the container and have the undesirable consequence of raising the container position to make room for enlarged underlying supports. This to some extent defeats the purpose of the well car. Lindauer, U.S. Pat. No. 4,771,706, uses support castings to transfer the loads to the side sills.

A related problem of prior art container support structures is they transfer bending loads to the side sills. Consequently, the side sills must be designed to withstand not only the vertical loads imposed by the weight of the container but also the bending moment transferred to the sills by the container supports.

SUMMARY OF THE INVENTION

The present invention overcomes the problems enumerated above by providing a container support assembly for a railroad well car which isolates bending loads in the container support and does not transfer them to the side sills. Further, since the bending loads applied on opposite sides of the container support assembly act in opposite senses, they are counteracted by a pair of transverse support beams in tension.

These results are achieved by a well car having a car body including two side sills connected to two end frames and mounted on suitable trucks. The side sills and end frames define a well for receiving one or more cargo containers. The floor of the well is defined by a container support assembly on which the container rests. The container support assembly is hung from the side sills by four or more hanger straps. The hanger straps are preferably pinned to the side sills and container support assembly by transversely extending pins. The pins are retained in the side sills by anchors. The pinned connections of the hanger straps result in the straps being loaded substantially in tension only.

The container support assembly itself has two transverse support beams which include cast corner fittings. The corner fittings have upstanding clevises for receiving pins which connect the fittings to the hanger straps. The corner fittings also have pegs located so as to fit into the standard mounting receptacles on the bottom of a container. The support assembly has two longitudinal beams connected at their ends to the corner fittings of the transverse beams. Together the transverse and longitudinal beams form a rectangular frame. This frame is strengthened with suitable lateral and diagonal braces and may further include a lattice of strapping for container floor breakout protection.

BRIEF DESCRIPTION OF THE DRAWINGS

FIG. 7 is a side elevation view of a side sill, with portions broken away.

FIG. 8 is a plan view of a side sill, with portions broken away.

FIG. 9 is an enlarged section taken along line 9—9 of FIG. 7. 5 FIG. 10 is an enlarged section taken along line 10—10 of FIG. 7.

FIG. 11 is a side elevation view of a hanger strap anchor.

FIG. 12 is an end elevation view of a hanger strap anchor.

DETAILED DESCRIPTION OF THE INVENTION

Figure 1:
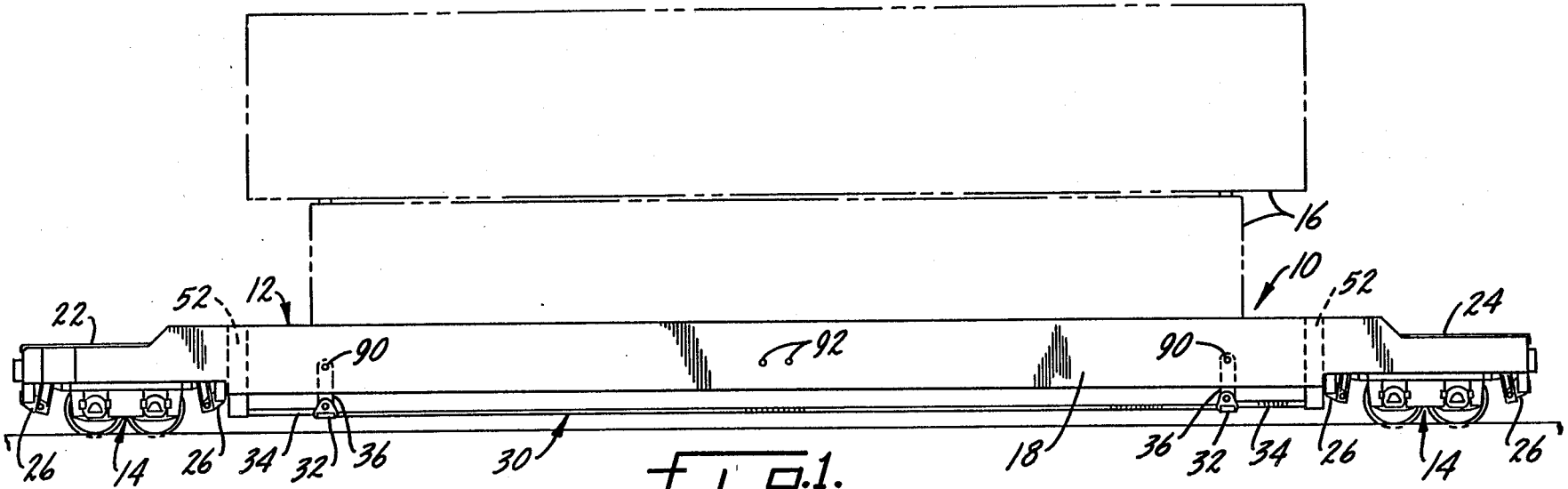
FIG. 1 is a side elevation view of the well car of the present invention, with two stacked containers shown in phantom.
Figure 2:
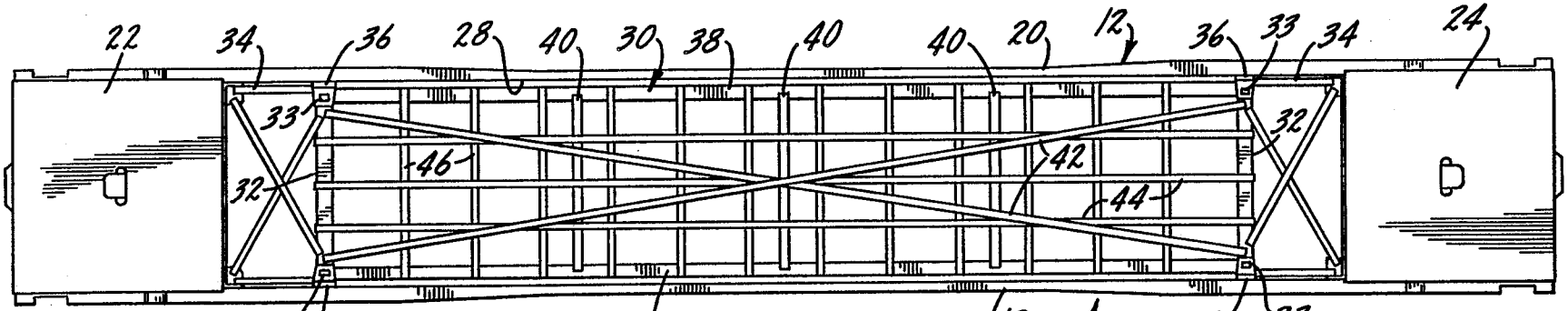
FIG. 2 is a plan view of the well car.

The well car of the present invention is shown generally at 10 in FIGS. 1 and 2. The car includes a car body 12 mounted at either end on suitable trucks 14. The trucks may be as shown in U.S. patent application Ser. No. 946,054 now U.S. Pat. No. 4,817,535, filed Dec. 24, 1986 and assigned to the present assignee. Two stacked containers are shown loaded in the well car at 16.

The car body 12 includes first and second side sills 18, 20 which are connected to end frame assemblies. In the particular embodiment shown, the end frame assemblies are draft sill assemblies 22 and 24. The draft sill assemblies include means for mounting the usual coupler mechanism. The draft sills also have brackets 26 (FIG. 1) for connection to the suspension means of the trucks 14. While the car is shown as a standalone car with its own trucks and couplers, it will be understood that the car body of the present invention could be adapted for use in an articulated car which has one or more intermediate, shared trucks.

The side sills 18, 20 and draft sills 22, 24 define a well 28 (FIG. 2). The bottom or floor of the well is defined by a container support frame assembly 30. The container support frame assembly includes a primary section bounded by two transverse support beams 32. The support beams are longitudinally spaced so as to match the standard locations of the mounting elements on the bottom of a container. In the illustrated embodiment the transverse support beams are located 40 feet apart to accommodate the mounting elements of 40, 45 and 48-foot containers. A container rests on the transverse support beams 32 with upstanding mounting pegs 33 engaging the mounting receptacles on the underside of the container structure.

The well 28 in the illustrated embodiment is 48 feet long and therefore will accommodate any standard size container. The spaces between the transverse support beams and the draft sills 22, 24 are filled by extension portions 34 of the container support frame assembly 30. In the example set forth herein, these extension portions 34 would be four feet long. The extension portions 34 abut the draft sills 22, 24 but are not otherwise connected thereto.

The container support frame assembly 30 is connected to the side sills 18, 20 by two pairs of hanger straps. Individual hanger straps are shown at 36. The hanger straps are pinned at their upper ends to the side sills and at their lower ends to the transverse support beams 32 of the container support frame assembly. Anchors built into the side sills retain the upper pins. As can be seen in FIG. 1, the hanger straps 36 suspend the container support frame assembly 30 beneath the bottom edge of the side sills. The hanger straps provide the only connection between the container support frame assembly and the side sills.

Figures 3, 4, 5, 6:
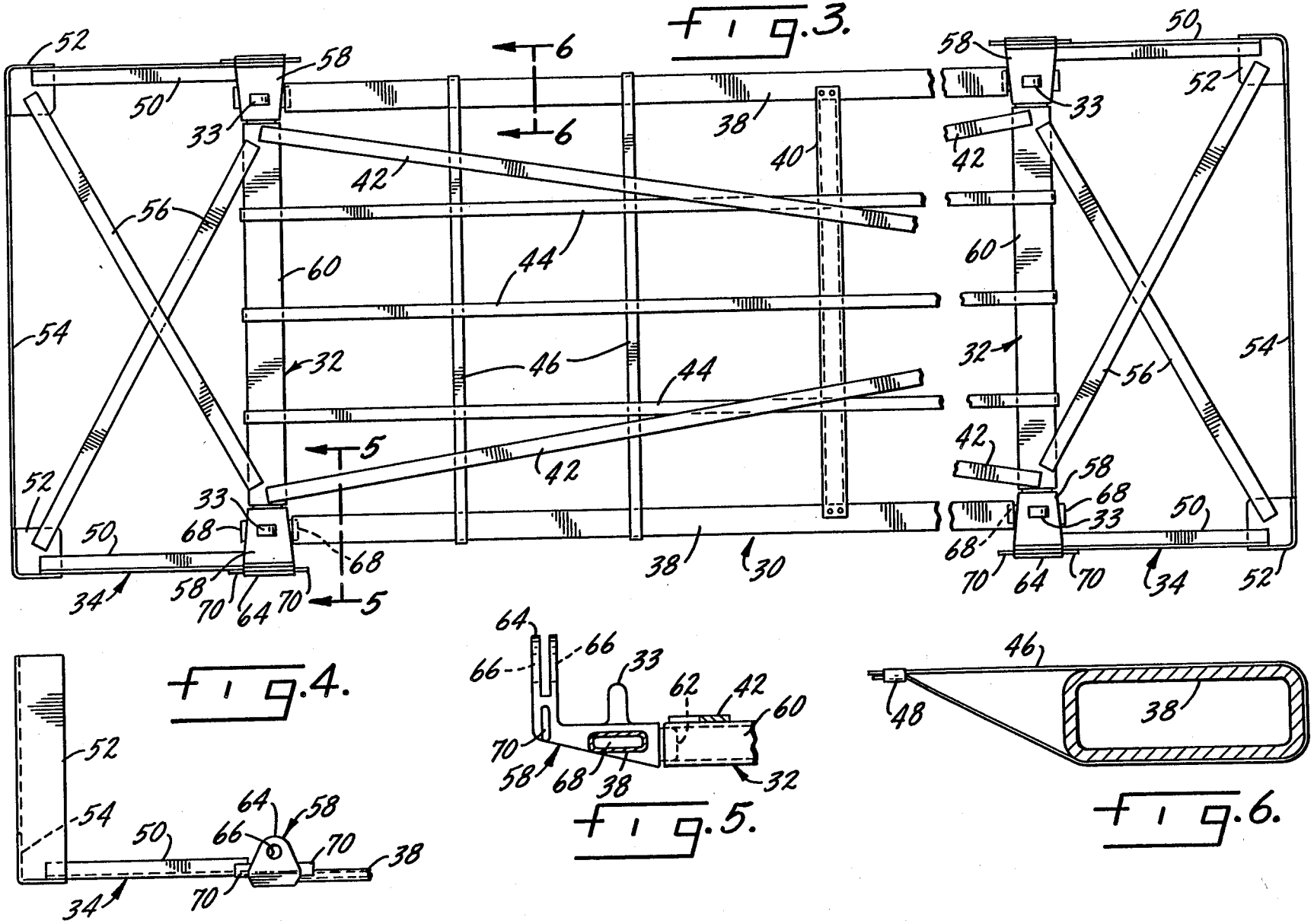
FIG. 3 is an enlarged plan view of a container support assembly according to the present invention.
FIG. 4 is a side elevation view of a portion of the container support assembly, showing the end of a transverse support beam and an extension portion of the assembly.
FIG. 5 is a section taken along line 5—5 of FIG. 3.
FIG. 6 is an enlarged section taken along line 6—6 of FIG. 3.

Details of the container support frame assembly 30 are shown in FIGS. 3–6. In addition to the two transverse support beams 32, there are two longitudinal beams 38 connected at their ends to the transverse beams 32. The longitudinal beams are rectangular tubes, as shown in FIG. 6. Together the beams 32 and 38 form the primary section of the support frame assembly. This section is reinforced by a plurality of lateral channel braces 40. Additional reinforcement for the primary section is provided by a pair of diagonal straps 42. The diagonal straps are installed after the container support frame assembly has been attached to the car body. The diagonal straps are pretensioned to approximately 500 pounds.

The frame assembly 30 further includes a lattice of longitudinal and lateral strapping shown at 44 and 46, respectively. The strapping 44, 46 serves to rigidify the support frame assembly. It also provides protection against container floor breakout. That is, if there is a failure of a container floor, the lading will not fall onto the track but instead will be restrained by the lattice. The strapping may be 2 inch by 0.065 inch steel. The lattice is interlaced and wrapped around the beams 32, 38, as shown in FIG. 6, and retained by clips 48.

The extension portions 34 of the container support frame assembly 30 have longitudinal angle supports 50 connected to the transverse beams 32. The angle supports are connected to upstanding corner members 52, as seen in FIG. 4. The corner members extend upwardly to approximately the top edge of the side sills. A lateral brace 54 extends between the two corner members to complete the rectangular framework of the extension portion. This framework is reinforced by diagonal braces 56. The dimensions of the extension portion are such that the corner members engage the corners of the well. Thus, the corner members abut an end of the well, as defined by one of the draft sills 22 or 24. This prevents the container support frame assembly from swinging longitudinally in the well. The corner members 52 also engage the inside edges of the side sills. This lends some extra resistance against inward flexing of the side sills.

Details of the transverse support beams 32 are shown in FIGS. 3, 4 and 5. Each support beam comprises two cast corner fittings 58 attached to the ends of a cross-member 60. The cross-member 60 is a tube which receives a plug 62 on the inner edge of the corner fitting 58 (see FIG. 5). The container locating pegs 33 are formed as part of the fittings 58. The fittings also include an upstanding clevis 64, the arms of which have openings 66 for receiving a pin to hold a hanger strap. Other features of the corner fitting include ears 68 which provide attachment points for the longitudinal beams 38. The fittings also have tabs 70 for attachment of the support angles 50 of the extension portions. As evident in FIG. 3, each fitting has two ears 68 and tabs 70, even though only one of each will be used in any particular location. The provision of dual ears and tabs permits the fitting to be used at any corner of the frame.

Turning now to the details of the side sill construction, FIGS. 7–10 illustrate the portions of one side sill encompassing one of the two end hanger strap anchors and the central anchor location. The sill is generally symmetrical about the middle of the central anchor so only half of one sill is shown. Also, while only half of one side sill has been shown, it will be understood that one sill will be equipped with the train line, and the other sill will have the hand brake rod and its associated equipment. These items are not shown in the drawings. Their installation will require minor differences between the two sills. These differences are not important to the understanding of the present invention.

As best seen in FIGS. 9 and 10, the side sills take the form of box beams. The box beams are defined by top and bottom chord assemblies and a plurality of inner and outer sheets. The top chord includes channel members 72A and 72B. The channel member 72B is somewhat narrower than member 72A. The two members are joined by a transition section which is flared to match the widths of the two members. This can be seen in FIG. 2.

The bottom chord includes a channel member 74A and a solid plate member 74B. The plate member is notched and tapered as at 76 (FIG. 7) at the junction with the channel member 74A. The bottom chord also has a separate plate member 74C at the ends of the sill. As seen in FIG. 7, the plate member 74C is vertically spaced from the end of the channel member 74A. These two members also longitudinally overlap. The plate member 74C extends to the end of the sill.

The outer sheets of the side sill extend from the top chord to the bottom chord. Outer sheet sections 78A through 78E are shown in the drawings. The outer side sheet sections 78 are stiffened by a plurality of longitudinal angle reinforcement members 80.

The inner side sheets include a plurality of upper sheets 82 and lower sheets 84. Upper inner sheet sections 82A through 82C are visible in FIG. 8. The lower inner side sheets 84 comprise eight separate sections along the entire length of the side sill. Only two of these are visible in the drawings. They are the third and fourth sections in from the ends of the sills and they are designated 84A and 84B.

A longitudinal stiffener assembly extends through the side sills, adjoining the inner and outer sheets. The stiffener assembly includes channel members 86A through 86F. As seen in FIGS. 9 and 10, the adjacent longitudinal edges of the inner side sheets 82 and 84 are joined to the inner flange of the longitudinal stiffeners 86.

Vertical stiffeners are provided at the joints between sheet sections. These stiffeners are in the form of channel members and they include upper portions 88A and lower portions 88B. Dividing the stiffeners in this manner allows the central stiffener 86E to extend through the sill from the central anchor to an end anchor. FIG. 9 shows openings 89 in the upper stiffener 88A which accommodate the train line, hand brake rod and the like. As best seen in FIG. 7, the joints between the outer sheets sections are made where the ends of the sheets overlap the underlying flanges of the vertical stiffeners 88.

Each side sill has a plurality of anchor locations for connecting the hanger straps 36. There are single anchors shown generally at 90 near the ends of the well and a dual anchor 92 at the midpoint of the sill. FIG. 1 illustrates the locations of the anchors. The single anchor 90 is shown in detail in FIGS. 11 and 12. The anchor has inner and outer support plates 94, 96 joined by a tube 98. It will be noted that the outer support plate is angled to match the contour of the outer sheet 78. The support plates 94 and 96 have beveled edges to facilitate welding. As shown in FIG. 10, the support plate 96 fits flush against the inside of the outer sheet 78B. An opening 100 is cut in the sheet 78B to provide access to the tube 98. The lower inner sheets 84 are longitudinally spaced in the area of the anchor so that they do not cover the face of the inner support plate 94.

The single anchors are positioned within an enclosure defined by the inner and outer sheets, the bottom chord and central stiffener, and by two vertical enclosure channels 102A and 102B. These enclosure channels extend from the top chord 72 to the bottom chord 74. Openings 103 permit passage of the train line or brake rod. Similar vertical channels 104A and B are provided on either side of the dual anchor member 92. Furthermore, a flanged vertical plate 106 is provided at the center of the dual anchor enclosure.

The upper end of a hanger strap 36 is connected to the anchor 90 by a pin 108 which extends through a hole in the strap and the tube 98 in the anchor. See FIG. 10. The pin has a head 110 engageable with the strap to prevent outward movement of the pin. A retainer 112 is welded to the pin after installation to prevent inward movement of the pin. The lower end of the hanger strap 36 is pinned to the clevis 64 of the transverse support beam 32. A pin 114 extends through the openings 66 of the clevis and through a hole in the bottom of the hanger strap 36. A head 116 on the pin prevents inward movement thereof. A pin keeper 118 is welded to the clevis after installation of the pin to prevent outward movement thereof.

It can be seen that the described structure provides a well car having a container support frame assembly suspended beneath the side sills of the car body. The pinned connection of the container support frame assembly to the side sills prevents transmission of bending moments to the sills. The hanger straps 36 are loaded almost purely in tension. The corner fittings 58 do see a bending load by virtue of the downward force of the container centered at the peg 33 and the resultant upward reaction force of the hanger strap on the clevis 64. For example, the corner fitting shown in FIG. 10 has a clockwise moment applied thereto. However, the corner fitting at the other end of the support beam would have a counterclockwise moment applied thereto. Since these two corner fittings are connected by the cross-member 60, the cross-member is in tension, which counteracts the bending moments on the corner fittings. With this arrangement, the bending moments are not transferred to the side sills. Similarly, if the location of the container support pegs 33 is moved inwardly to accommodate narrower width containers, the moments applied to the individual corner fittings would increase and the tension in the cross-members 60 would increase, but none of this would have any effect on the side sills which continue to see essentially zero bending load.

The invention has been shown and described with a single container support frame assembly having a 40-foot primary section and two 4-foot extension portions to fill the 48-foot well. Alternatively, two container support frame assemblies with 20-foot primary sections could be substituted therefor, each with one 4-foot extension portion at the ends of the well. In this latter case, the dual anchors 92 would also be provided with hanger straps to support the inner ends of the two 20-foot container support frame assemblies. Thus, there would be two support frame assemblies, each with two transverse support beams hung by two pairs of hanger straps. In a further alternate arrangement for the container support frame assembly, the 40-foot spacing of transverse support beams could be used without the extension portions.

It will be realized that other modifications could be made to the car as shown without departing from the scope of the following claims.

What is claimed:

1. A railroad car for carrying containers, comprising:
a car body mounted on first and second trucks, the car body comprising first and second side sills each connected at their ends to end frame assemblies, the side sills and end frame assemblies defining a well adapted for receiving a container therein;
at least two pairs of elongated hanger straps, each strap having upper and lower ends, the upper ends being connected to the side sills with the straps of each pair being aligned on opposite sills;
at least one container support frame assembly defining a floor of the well and including at least two transverse support beams which are connected near their ends to the lower ends of a pair of hanger straps, the support beams including mounting means for securing a container on the support frame assembly.

2. The railroad car of claim 1 wherein the upper ends of the hanger straps are pivotally connected to the side sills by first pivotal connecting means.

3. The railroad car of claim 2 wherein the first pivotal connecting means include pin connecting the upper ends of the hanger straps to the side sills.

4. The railroad car of claim 1 wherein the lower ends of the hanger straps are pivotally connected to the transverse support beams of the container support frame assembly by second pivotal connecting means.

5. The railroad car of claim 4 wherein the second pivotal connecting means include pins connecting the lower ends of the hanger straps to the transverse support beams.

6. The railroad car of claim 4 wherein the upper ends, of the hanger straps are pivotally connected to the side sills by first pivotal connecting means.

7. The railroad car of claim 1 wherein the first pivotal connecting means include pins connecting the upper ends of the hanger straps are connected by pins to the side sills, the pins extending through the side sills and being supported therein by anchors.

8. The railroad car of claim 7 further characterized in that the side sills comprise box beams formed by inner and outer sheets and top and bottom chords, and wherein each anchor comprises at least one tube, through which the pin extends, reinforced by inner and outer support plates which are engaged with the inner and outer sheets, respectively.

9. The railroad car of claim 8 further comprising vertical stiffeners on either side of the anchors, extending between the inner and outer sheets and the top and bottom chords of the side sills.

10. The railroad car of claim 1 wherein the container support frame assembly extends the full length of the well and abuts the end frame assemblies.

11. The railroad car of claim 1 wherein the container support frame assembly further comprises at least two longitudinal beams connected at their ends to the transverse support beams to form a generally rectangular frame.

12. The railroad car of claim 11 wherein the container support frame assembly further comprises at least one lateral brace connected between the longitudinal beams.

13. The railroad car of claim 11 wherein the container support frame assembly further comprises at least one diagonal strap connected between the longitudinal beams.

14. The railroad car of claim 11 wherein the container support frame assembly further comprises interlaced longitudinal and lateral strapping connected between the transverse support beams and longitudinal beams.

15. The railroad car of claim 11 wherein the container support frame assembly further comprises at least one extension portion connected to one of the transverse support beams, the extension portion abutting the end frame assembly.

16. The railroad car of claim 15 wherein the extension portion comprises longitudinal angle supports, upstanding corner members connected to said angle supports and extending to the top of the side sills, and a lateral brace connecting said corner members.

17. The railroad car of claim 1 wherein each transverse support beam includes a corner fitting at each end having attachment means for connecting a lower end of a hanger strap thereto.

18. The railroad car of claim 17 wherein the attachment means of the corner fitting comprises an upstanding clevis.

19. The railroad car of claim 17 wherein the corner fitting is a casting.

20. The railroad car of claim 19 wherein the corner fittings of a transverse support beam are fixedly attached to the opposite ends of a cross-member.

21. The railroad car of claim 17 wherein the mounting means for securing a container on the support frame assembly comprises an upstanding peg formed on each corner fitting.

22. The railroad car of claim 1 wherein there are four pairs of hanger straps supporting two container support frame assemblies.

23. A railroad car for carrying containers, comprising:

first and second side sills each connected to first and second trucks at the ends of the sills;

a plurality of hanger straps, each strap having upper and lower ends, the upper ends being connected to the side sills;

a container support frame assembly including means for mounting a container on the support frame assembly, the frame assembly being connected to the lower ends of the hanger straps such that the hanger straps are stressed substantially in tension only and the connection of the hanger straps to the side sills being such that the hanger straps transfer tensile loads but not bending loads to the side sills.

24. The railroad car of claim 23 wherein the upper ends of the hanger straps are pivotally connected to the side sills by first pivotal connecting means.

25. The railroad car of claim 24 wherein the first pivotal connecting means include pin connecting the upper ends of the hanger straps to the side sills.

26. The railroad car of claim 23 wherein the lower ends of the hanger straps are pivotally connected to transverse support beams of the container support frame assembly by second pivotal connecting means.

27. The railroad car of claim 26 wherein the second pivotal connecting means include pins connecting the lower ends of the hanger straps to the transverse support beams.

28. The railroad car of claim 26 wherein the upper ends of the hanger straps are pivotally connected to the side sills by first pivotal connecting means.

29. The railroad car of claim 23 wherein the first pivotal connecting means include pins connecting the upper ends of the hanger straps to the side sills, the pins extending through the side sills and being supported therein by anchors.

30. The railroad car of claim 29 further characterized in that the side sills comprise box beams formed by inner and outer sheets and top and bottom chords, and wherein each anchor comprises at least one tube, through which the pin extends, reinforced by inner and outer support plates which are engaged with the inner and outer sheets, respectively.

31. The railroad car of claim 30 further comprising vertical stiffeners on either side of the anchors, extending between the inner and outer sheets and the top and bottom chords of the side sills.

32. The railroad car of claim 23 further comprising end frame assemblies connected to the ends of the first and second side sills, the side sills and end frame assemblies defining a well adapted for receiving a container therein and wherein the container support frame assembly extends the full length of the well and abuts the end frame assemblies.

33. The railroad car of claim 23 wherein the container support frame assembly further comprises at least two longitudinal beams connected at their ends to transverse support beams to form a generally rectangular frame.

34. The railroad car of claim 33 wherein the container support frame assembly further comprises at least one lateral brace connected between the longitudinal beams.

35. The railroad car of claim 33 wherein the container support frame assembly further comprises at least one diagonal strap connected between the longitudinal beams.

36. The railroad car of claim 33 wherein the container support frame assembly further comprises interlaced longitudinal and lateral strapping connected between the transverse support beams and longitudinal beams.

37. The railroad car of claim 33 wherein the container support frame assembly further comprises at least one extension portion connected to one of the transverse support beams, the extension portion abutting the end frame assembly.

38. The railroad car of claim 37 wherein the extension portion comprises longitudinal angle supports, upstanding corner members connected to said angle supports and extending to the top of the side sills, and a lateral brace connecting said corner members.

39. The railroad car of claim 23 wherein each transverse support beam includes a corner fitting at each end having attachment means for connecting a lower end of a hanger strap thereto.

40. The railroad car of claim 39 wherein the attachment means of the corner fitting comprises an upstanding clevis.

41. The railroad car of claim 39 wherein the corner fitting is a casting.

42. The railroad car of claim 41 wherein the corner fittings of a transverse support beam are fixedly attached to the opposite ends of a cross-member.

43. The railroad car of claim 39 wherein the mounting means for securing a container on the support frame assembly comprises an upstanding peg formed on each corner fitting.

44. The railroad car of claim 23 wherein there are four pairs of hanger straps supporting two container support frame assemblies.

* * * * *